United States Patent [19]

Valdez

[11] Patent Number: 4,782,866

[45] Date of Patent: Nov. 8, 1988

[54] LOG SPLITTING HEAD

[76] Inventor: Charlie Valdez, 8171 Deer Creek Rd., Selma, Oreg. 97538

[21] Appl. No.: 145,374

[22] Filed: Jan. 19, 1988

[51] Int. Cl.[4] ..... B27L 7/00

[52] U.S. Cl. ..... 144/193 E; 144/193 A

[58] Field of Search ..... 144/3 K, 193 R, 193 A, 144/193 E, 366; 254/104

[56] References Cited

U.S. PATENT DOCUMENTS

| | | | |
|---|---|---|---|
| 4,353,401 | 10/1982 | Schilling | 144/193 |
| 4,371,020 | 2/1983 | Barnes et al. | 144/366 |
| 4,391,312 | 7/1983 | Sakraida, Jr. | 144/193 E |
| 4,421,149 | 12/1983 | Barnes et al. | 144/366 |
| 4,445,556 | 5/1984 | Williams | 144/193 R |
| 4,478,263 | 10/1984 | Johnston | 144/193 E |
| 4,561,479 | 12/1985 | Burdine | 144/193 B |

FOREIGN PATENT DOCUMENTS

| | | | |
|---|---|---|---|
| 0054252 | 6/1982 | European Pat. Off. | 144/193 E |
| 3606194 | 8/1987 | Fed. Rep. of Germany | 144/193 A |
| 729365 | 12/1966 | Italy . | |

*Primary Examiner*—W. Donald Bray

*Attorney, Agent, or Firm*—Klarquist, Sparkman, Campbell, Leigh & Whinston

[57] ABSTRACT

A log splitting head is disclosed which includes a downwardly-sloped top portion having a sharpened leading edge in the form of a V-shaped cutting blade. Beneath the top portion, a first row of vertical cutting blades is provided, each including a sharpened leading edge. Also included is a second row of vertical cutting blades beneath the first row of blades and structurally similar thereto. Separating the two rows of blades is a medial portion having a sharpened leading edge. The sides of the splitting head include two vertical plates having sharpened leading edges. All of these components are arranged in a specific angular configuration designed to accomplish log splitting with maximum efficiency. The entire unit is adapted for attachment to a horizontal platform, and enables the splitting of logs into uniformly sized sections.

21 Claims, 2 Drawing Sheets

LOG SPLITTING HEAD

BACKGROUND OF THE INVENTION

The present invention generally relates to log splitting heads, and more specifically to a log splitting head of improved efficiency having a plurality of vertical and horizontal blade members integrated into a single unit.

When harvesting wood products, it is often necessary to cut large logs into smaller, more uniform sections. Size reduction facilitates further processing of the wood and transportation of the harvested wood by commercial vehicles. Furthermore, many uses for raw wood require a substantial reduction in size. These uses include combustion of the wood as a fuel source, and other related applications.

A variety of mechanical devices have been designed to split logs into smaller portions. For example, U.S. Pat. No. 4,391,312 to Sakraida discloses a log splitting head having a base plate, two vertical plates, and a top plate assembled to form a box-like structure. The leading edges of these components are sharpened to form cutting blades.

U.S. Pat. Nos. 4,421,149 and 4,371,020 to Barnes et al; and 4,353,401 to Schilling all disclose circular splitting heads designed to cut a log into sector-shaped segments. These systems include a ring structure having a plurality of radially disposed blades which converge at the center of the structure.

U.S. Pat. No. 4,561,479 to Burdine discloses a mechanical wood splitter having a drum elevated above a log by a cable system on a support column. The drum includes a cruciform cutting assembly. In operation, the drum and cutting assesmbly travel downward from the top of the support column with sufficient force to split the log.

U.S. Pat. No. 4,445,556 to Williams discloses a knife assembly for producing wood chunks. The assembly includes a plurality of blades mounted to a plate for cutting wooden disks into wedge-shaped portions.

Italian Pat. No. 729,365 discloses a grate-like cutter including numerous vertical and horizontal blade sections. A log is forced against the cutter by a splitting ram, which cuts the log into a plurality of sections.

Notwithstanding the systems described above, a need exists for a splitting head which is capable of cutting both large and small logs into uniform sections in a fast and efficient manner. A need also exists for a splitting head which requires minimal maintenance and is usable in large-scale, commercial harvesting operations. The splitting head of the present invention has a distinctive arrangement of blades integrated into a single unit which accomplishes these goals.

SUMMARY OF THE INVENTION

The present invention involves a log splitting head characterized by superior operating efficiency. It includes a downwardly-sloped top portion having a V-shaped cutting edge. Beneath the top portion, a first row of vertical blades is provided, each including a sharpened leading edge angled inwardly toward the interior of the splitting head. Also included is a second row of vertical blades beneath the first row of blades. Separating the two rows of vertical blades is a medial portion having a sharpened leading edge. The sides of the splitting head include two vertical plates also having sharpened leading edges. All of these components are arranged in a specific angular configuration designed to accomplish log splitting with maximum efficiency. The entire unit is adapted for attachment to a horizontal platform and enables the splitting of logs into uniformly sized portions.

In accordance with the foregoing, it is an object of the present invention to provide a log splitting head capable of splitting logs in a fast and efficient manner.

It is another object of the invention to provide a log splitting head capable of cutting different sized logs into portions of uniform size.

It is another object of the invention to provide a log splitting head of rugged construction which requires minimal maintenance and repair.

It is another object of the invention to provide a log splitting head of minimal weight and size which is easily transported to a work area.

It is a further object of the invention to provide a log splitting head simple in construction and manufactured from inexpensive, readily available components.

It is an even further object of the invention to provide a log splitting head which includes a plurality of vertical and horizontal blade members integrated into a single unit.

These and other objects will be described below in the following detailed description of a preferred embodiment.

DETAILED DESCRIPTION OF A PREFERRED EMBODIMENT

Figure 1:
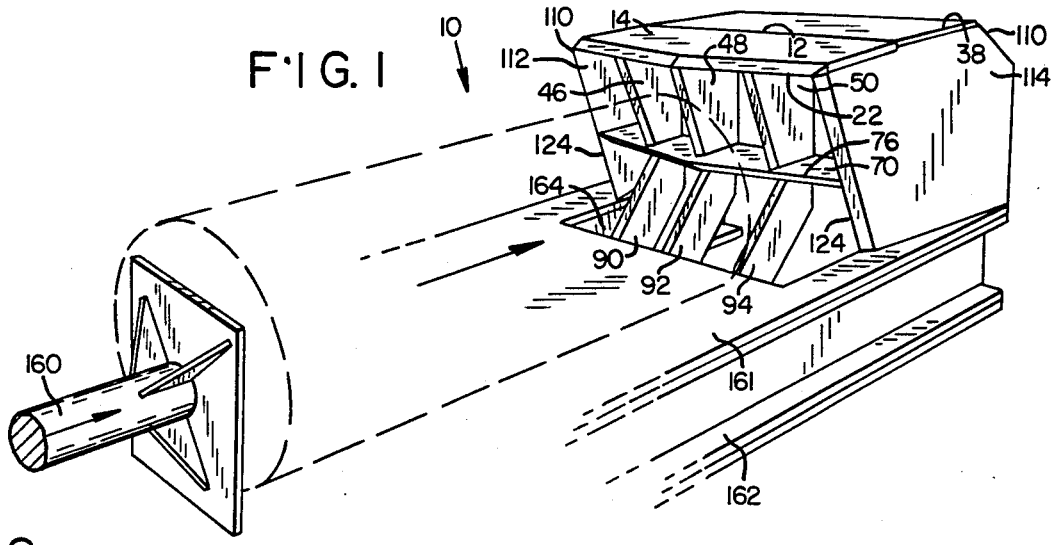
FIG. 1 is a perspective view of a log splitting head in accordance with the present invention attached to a horizontal support member.

With reference to FIG. 1, the splitting head 10 of the present invention consists of a substantially box-like, integrated structure which is rugged in construction, yet easily transported to a work site.

Figure 2:
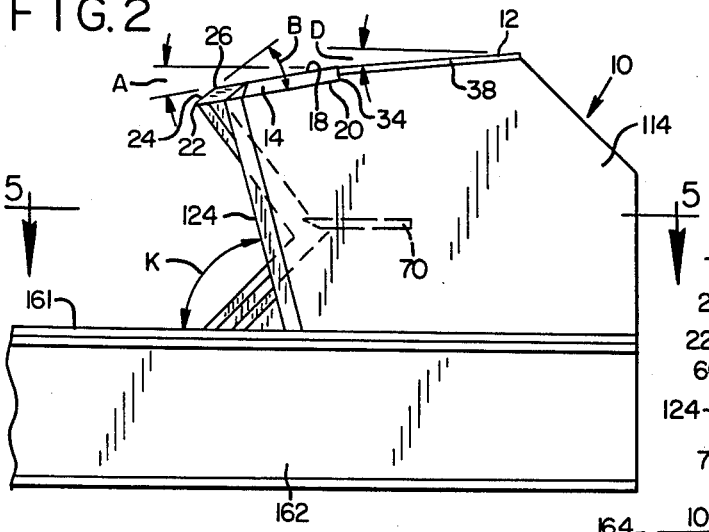
FIG. 2 is a side view of the splitting head.
Figure 4:
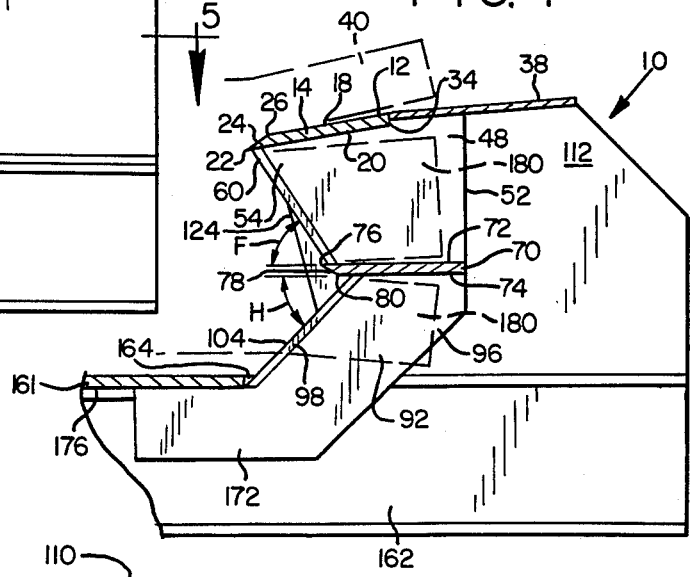
FIG. 4 is a cross sectional view of the splitting head taken along lines 4—4 of FIG. 3.
Figure 3:
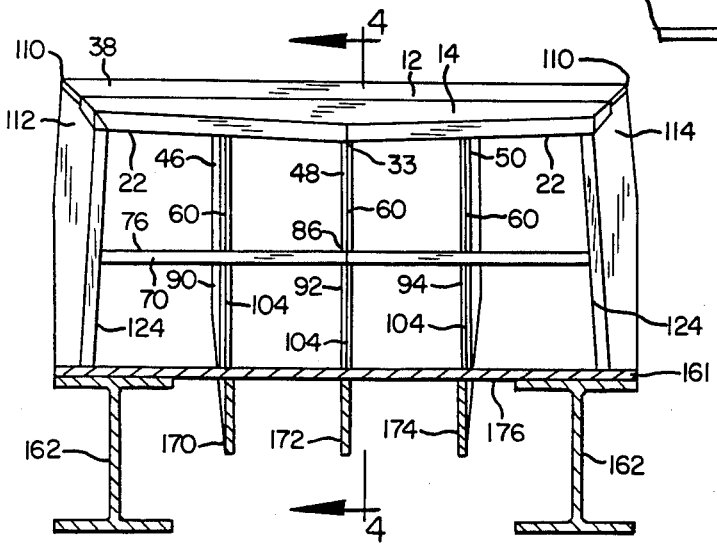
FIG. 3 is a front view of the splitting head.

The head 10 includes a top portion 12 in the form of a horizontal splitting blade assembly. As shown in FIGS. 2 and 4, the top portion 12 includes a planar cutting section 14 having an upper face 18, and a lower face 20 which are parallel to each other. The cutting section 14 slopes downwardly at approximately a 10° angle as illustrated at reference letter "A" in FIG. 2.

The lower face 20 of the cutting section 14 terminates in a sharpened leading edge 22. Adjacent the edge 22 and extending upwardly at an angle is a planar portion 24 which terminates at the leading edge 26 of the upper face 18. This design results in a blade structure more commonly known as a "single face" grind.

The angle between planar portion 24 and the lower face 20 is approximately 25°, as illustrated at reference letter "B", and shall hereinafter be designated as the "blade angle". Unless otherwise indicated, the blade angle for all the cutting edges described herein is approximately 25°.

Figure 6:
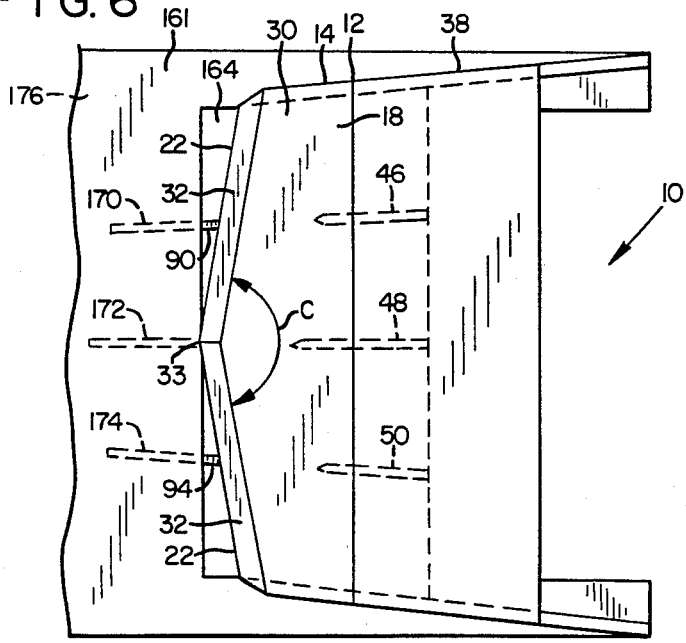
FIG. 6 is a top view of the splitting head.

With reference to FIG. 6, the front 30 of the cutting section 14 is divided into two longitudinal portions 32 of equal length. Portions 32 form an angle of approximately 164° with respect to each other, as illustrated by reference letter "C". This design creates a point or apex 33 in the middle of the cutting section 14 which is highly effective in the log splitting process.

Immediately adjacent end 34 of the cutting section 14 is a top panel 38 (FIGS. 2 and 4). Top panel 38 slopes downwardly at an angle of approximately 6° (reference letter "D" in FIG. 2.)

The downwardly-sloped design of the top panel 38 and cutting section 14 facilitates the upward movement of extraneous portions of the log (e.g., branches etc.) over the top of the splitting head 10 so that they may be easily removed. Likewise, if the diameter of the log is larger than the overall height of the splitting head 10, the portions thereof extending beyond the top of the splitting head 10 (shown at reference numeral 40 in FIG. 4) will be cut and passed over the top of the head 10 for easy removal.

Figure 5:
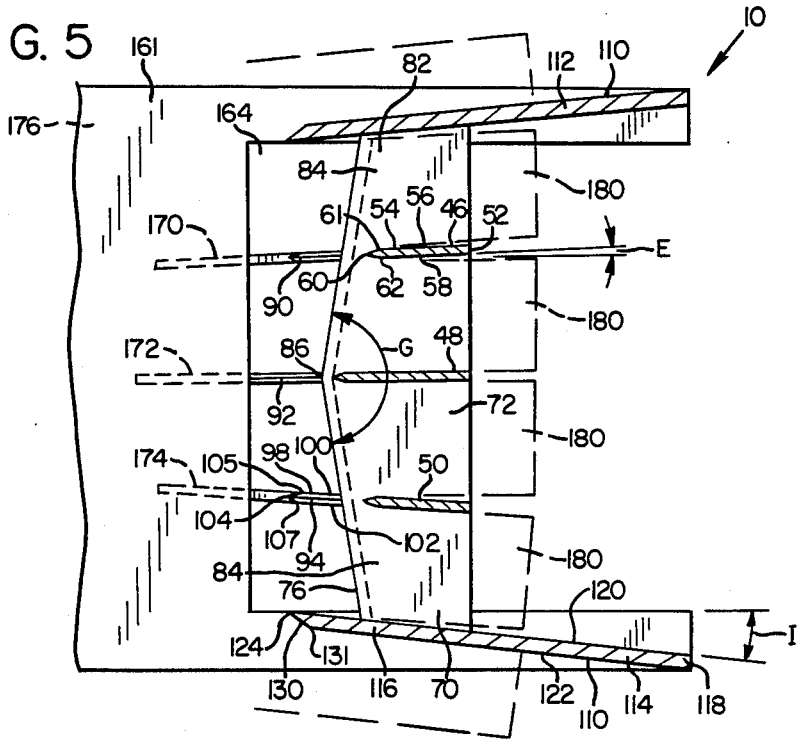
FIG. 5 is a cross sectional view of the splitting head taken along lines 5—5 of FIG. 2.

As shown in FIGS. 1 and 3–5, positioned directly beneath the top portion 12 is a first row of vertical blade members 46, 48 and 50. Vertical blade member 48 is positioned between and equally spaced from blade members 46, 50 (FIG. 5). With continued reference to FIGS. 4 and 5, each of the blade members 46, 48 and 50 includes a rear portion 52, front portion 54, first face 56 and second face 58. The faces 56, 58 are parallel to each other. The front portion 54 of each blade member 46, 48, 50 also includes a sharpened leading edge 60 spaced equidistantly from the leading edges 61, 62 of faces 56, 58 as illustrated in FIG. 5. The design is more commonly known as a "double face" blade grind with a blade angle of 25°.

As shown in FIG. 5, the blade member 48 is longer than the blade members 46, 50 which are equal in length. In addition, the rear portions 52 of the blade members 46, 50 are tilted outwardly at approximately a 3° angle as illustrated by letter "E" in FIG. 5.

With reference to FIG. 4, the sharpened leading edges 60 of the blade members 46, 48, 50 extend inwardly toward the interior of the splitting head 10 at an angle. The specific angular configuration of the sharpened leading edges 60 will be further described in detail below.

Directly beneath the vertical blade members 46, 48, 50 is a medial horizontal cutting blade 70 which is planar in configuration (FIGS. 1–5). The blade 70 includes an upper face 72 and a lower face 74 which are parallel to each other (FIG. 4). The upper face 72 terminates in a sharpened leading edge 76. Adjacent the edge 76 is a planar portion 78 extending downward at an angle which terminates at the leading edge 80 of the lower face 74. Like the cutting portion 14 described above, blade 70 uses a "single face" grind with a blade angle of 25°.

As shown in FIG. 4, an acute angle (less than 90°) is formed between the leading edges 60 of the vertical blade members 46, 48, 50 and blade 70. In the embodiment of FIG. 4, this angle is approximately 56°, as illustrated by reference letter "F".

In addition, the front 82 of the blade 70 is divided into two longitudinal portions 84 of equal length. Portions 84 form an angle of approximately 164° with respect to each other, as illustrated by reference letter "G" in FIG. 5. This design creates a point or apex 86 in the middle of the blade 70.

Directly beneath the blade 70 as indicated in FIGS. 1 and 3–5 is a second row of vertical blade members 90, 92 and 94. Vertical blade member 92 is positioned between and equally spaced from blade members 90, 94. With reference to FIGS. 4 and 5, each of the blade members 90, 92, 94 includes a rear portion 96, front portion 98, first face 100, and second face 102 which are parallel to each other. The front portion 98 of each blade member 90, 92, 94 also includes a sharpened leading edge 104 spaced equidistantly from the leading edges 105, 107 of the faces 100, 102 as illustrated in FIG. 5. This results in a "double face" grind with a blade angle of 25°.

Referring to FIG. 5, blade member 92 is longer than blade members 90, 94 which are equal in length. In addition, the rear portions 96 of the blade members 90, 94 are tilted outwardly at approximately a 3° angle, and are thus angularly oriented in an identical manner with vertical blade members 46, 50.

An acute angle is formed between the leading edges 104 of the blade members 90, 92, 94 and blade 70. In the embodiment of FIG. 4, this angle is approximately 45°, as indicated by reference letter "H".

A the sides 110 of the splitting head 10, two planar vertical panels 112, 114 are provided (FIGS. 1–3 and 5). Vertical panels 112, 114 each include a front portion 116, a rear portion 118, inner face 120, and outer face 122 (FIG. 5). The inner and outer faces 120, 122 are parallel to each other. With continued reference to FIG. 5, the inner face 120 terminates in a sharpened leading edge 124. Adjacent the edge 124 and extending outwardly at an angle is a planar portion 130 which terminates at the leading edge 131 of the outer face 122. This again results in a "single face" grind with a blade angle of 25°.

As shown in FIG. 5, the rear portions 118 of the vertical panels 112, 114 are tilted outwardly at approximately a 6° angle as indicated by reference letter "I" in FIG. 5. In addition, the edge 124 extends downwardly at about a 75° angle relative to the platform on which the head 10 is mounted (reference letter "K" in FIG. 2).

The components of the splitting head 10 are designed to be secured together by welding or the like. A variety of metal materials may be used to form such components. However, it is preferred that the vertical blade members 46, 48, 50, 90, 92 and 94 and medial blade 70 be constructed of "T-1" steel, with the other components of the splitting head 10 including the top portion 12, and vertical panels 112, 114 being constructed of "mild" steel.

The splitting head 10 may be secured to and used in conjunction with any log delivery system, including those using a hydraulic ram 160 (FIG. 1). In FIG. 1, the splitting head 10 is rigidly secured to a horizontal plate 161 wih an opening 164, the plate 161 being supported by I-beams 162. The splitting head 10 may be bolted and/or welded in position. To further secure the splitting head 10 to the plate 161, each of the vertical blade members 90, 92 and 94 includes an extension section 170, 172 and 174 designed for attachment adjacent the underside 176 of the plate 161 (FIGS. 4 and 5).

Notwithstanding the type of log delivery systems being used, the splitting head 10 will efficiently split a log into uniform sections as shown in FIGS. 4 and 5 (with the log being designated by reference numeral 180).

Having herein described a preferred embodiment of the invention, it is contemplated that individuals skilled in the art may make suitable modifications within the scope of the invention. Therefore, the invention shall only be construed in accordance with the following claims.

What is claimed is:

1. A log splitting head adapted for mounting to a horizontal platform comprising:

an upper horizontal blade member;

a first row of a plurality of vertical blade members beneath said upper horizontal blade member;

a second row of a plurality of vertical blade members beneath said first row of vertical blade members;

a medial horizontal blade member positioned between said first row of vertical blade members and said second row of vertical blade members; and a vertical panel at each side of said head, said first row of vertical blade members, second row of vertical blade members, and medial horizontal blade member being positioned therebetween.

2. The log splitting head of claim 1 wherein said upper horizontal blade member comprises a downwardly sloping cutting portion having a sharpened leading edge.

3. The log splitting head of claim 2 wherein said cutting portion slopes downward about 10 degrees.

4. The log splitting head of claim 2 wherein said sharpened leading edge of said cutting portion comprises a first longitudinal section and a second longitudinal section each being of equal length and oriented at an angle relative to each other to form a V-shaped cutting edge.

5. The log splitting apparatus of claim 2 wherein said cutting portion is planar in configuration and comprises an upper face and a lower face, said faces being parallel to each other, said lower face terminating in said sharpened leading edge.

6. The log splitting head of claim 1 wherein each of said vertical blade members in said first and second rows comprises a sharpened leading edge and a rear portion, each leading edge forming an acute angle relative to said medial horizontal blade member.

7. The log splitting head of claim 6 wherein said first and second rows of vertical blade members each comprises a first and second outer blade member and an inner blade member between said outer blade members, said inner blade member being longer than said outer blade members, with said outer blade members being equal in length and spaced at an equal distance from said inner blade member.

8. The log splitting head of claim 7 wherein said rear portions of said first and second outer blade members of said first and second rows are tilted outwardly at about a 3° angle 9. The log splitting head of claim 6 wherein said sharpened leading edges of said vertical blade members of said first row each form about a 56° angle relative to said medial horizontal blade member.

10. The log splitting head of claim 6 wherein said sharpened leading edges of said vertical blade members of said second row each form about a 45° angle relative to said medial horizontal blade member.

11. The log splitting head of claim 1 wherein said medial horizontal blade member is planar in configuration and comprises an upper face and a lower face, said faces being parallel to each other, said upper face terminating in a sharpened leading edge.

12. The log splitting head of claim 11 wherein said sharpened leading edge of said medial horizontal blade member comprises a first longitudinal section and a second longitudinal section each being of equal length and oriented at an angle relative to each other to form a V-shaped cutting edge.

13. The log splitting head of claim 1 wherein each of said vertical panels is planar in configuration and comprises an inner face and an outer face, said faces being parallel to each other, said inner face terminating in a sharpened leading edge.

14. The log splitting head of claim 13 wherein said sharpened leading edge of each vertical panel forms about a 75° angle relative to said horizontal platform.

15. The log splitting head of claim 14 wherein said vertical panels each comprises a rear portion which is tilted outwardly at about a 6° angle.

16. The log splitting head of claim 1 further comprising mounting means for securing said log splitting head to said horizontal platform.

17. The log splitting head of claim 16 wherein said mounting means comprises at least one extension member secured to each of said vertical blade members of said second row, said extension member being adapted to engage the underside of said horizontal platform to enable said splitting head to be maintained in position thereon.

18. A log splitting head adapted for mounting to a horizontal platform comprising:

an upper horizontal blade member comprising a downwardly sloping cutting portion having a sharpened leading edge, said sharpened leading edge comprising a first longitudinal section and a second longitudinal section each being of equal length and oriented at an angle relative to each other to form a V-shaped cutting edge;

a first row of a plurality of vertical blade members beneath said upper horizontal blade member, each of said vertical blade members in said first row comprising a sharpened leading edge;

a second row of a plurality of vertical blade members beneath said first row of vertical blade members, each of said vertical blade members in said second row comprising a sharpened leading edge;

a medial horizontal blade member positioned between said first row of vertical blade members and said second row of vertical blade members, said sharpened leading edges of said vertical blade members in said first and second rows each forming an acute angle relative to said medial horizontal blade member, said medial horizontal blade member comprising a sharpened leading edge divided into a first longitudinal section and a second longitudinal section each being of equal length and oriented at an angle relative to each other to form a V-shaped cutting edge; and a vertical panel at each side of said head, said first row of vertical blade members, second row of vertical blade members, and medial horizontal blade member being positioned therebetween, each vertical panel comprising a sharpened leading edge.

19. The log splitting head of claim 18 comprising mounting means for securing said log splitting head to said horizontal platform.

20. The log splitting head of claim 19 wherein said mounting means comprises at least one extension member secured to each of said vertical blade members of said second row, said extension member being adapted to engage the underside of said horizontal platform to enable said splitting head to be maintained in position thereon.

21. A log splitting head adapted for mounting to a horizontal platform comprising:

an upper horizontal blade member comprising a downwardly sloping cutting portion having a sharpened leading edge, said cutting portion sloping downward at about a 10° angle; said sharpened leading edge comprising a first longitudinal section and a second longitudinal section each being of equal length and oriented at an angle relative to each other to form a V-shaped cutting edge, said cutting portion further comprising an upper face and a lower face parallel to each other, said lower face terminating in said sharpened leading edge;

a first row of a plurality of vertical blade members beneath said upper horizontal blade member, each vertical blade member of said first row comprising a sharpened leading edge and a rear portion, said plurality of vertical blade members of said first row comprising first and second outer blade members and an inner blade member between said outer blade members, said inner blade member being longer than said outer blade members, with said outer blade members being equal in length and spaced at an equal distance from said inner blade member, said rear portions of said first and second outer blade members being tilted outwardly at about a 3° angle;

a second row of a plurality of vertical blade members beneath said first row of vertical blade members, each vertical blade member of said second row comprising a sharpened leading edge and a rear portion, said plurality of vertical blade members of said second row comprising first and second outer blade members and an inner blade member between said outer blade members, said inner blade member being longer than said outer blade members, with said outer blade members being equal in length and spaced at an equal distance from said inner blade member, said read portions of said first and second outer blade members being tilted outwardly at about a 3° angle;

a medial horizontal blade member positioned between said first row of vertical blade members and said second row of vertical blade members, said medial horizontal blade member comprising an upper face and a lower face, said faces being parallel to each other, said upper face terminating in a sharpened leading edge, said sharpened leading edge comprising a first longitudinal section and a second longitudinal section each being of equal length and oriented at an angle relative to each other to form a V-shaped cutting edge, said sharpened leading edges of said vertical blade members of said first row each forming about a 56° angle relative to said medial horizontal blade member, and said sharpened leading edges of said vertical blade members of said second row each forming about a 45° angle relative to said medial horizontal blade member;

a vertical panel at each side of said head, said first row of vertical blade members, second row of vertical blade members and medial horizontal blade member being positioned therebetween, each vertical panel comprising an inner face and an outer face parallel to each other, said inner face terminating in a sharpened leading edge, said sharpened leading edge forming an angle of about 75° relative to said horizontal platform, each vertical panel further comprising a rear portion which is tilted outwardly at about a 6° angle; and mounting means for securing said log splitting head to said horizontal platform comprising at least one extension member secured to each of said vertical blade members of said second row, said extension member being adapted to engage the underside of said horizontal platform to enable said splitting head to be maintained in position thereon.

* * * * *